US005902503A

United States Patent [19]

Bührer et al.

[11] Patent Number: 5,902,503

[45] Date of Patent: May 11, 1999

[54] HEATED GODET FOR THE HEATING OF SYNTHETIC YARN

[75] Inventors: Matthias Bührer, Boll-Eckwälden, Germany; Heinz Von Arx, Meisterschwanden, Switzerland

[73] Assignees: Zinser Textilmaschinen GmbH, Ebersbach/Fils, Germany; Retech AG H Von Arx, Meisterschwanden, Switzerland

[21] Appl. No.: 08/819,332

[22] Filed: Mar. 18, 1997

[30] Foreign Application Priority Data

Mar. 19, 1996 [DE] Germany ..... 196 10 763

[51] Int. Cl.[6] ..... B21B 27/06

[52] U.S. Cl. ..... 219/470; 165/89; 226/168

[58] Field of Search ..... 219/470, 469, 219/471, 619; 264/147

[56] References Cited

U.S. PATENT DOCUMENTS

| | | | |
|---|---|---|---|
| 3,382,555 | 5/1968 | Smoots | 28/62 |
| 3,562,472 | 2/1971 | Cannon | 219/10.61 |
| 3,576,081 | 4/1971 | McCrary | 34/153 |
| 3,843,868 | 10/1974 | Wittaker | 219/470 |
| 3,943,222 | 3/1976 | Waterhouse et al. | 264/147 |
| 4,097,723 | 6/1978 | Leitner et al. | 219/494 |
| 4,443,689 | 4/1984 | Muller et al. | 219/469 |
| 4,658,716 | 4/1987 | Boissevain | 100/38 |
| 4,880,961 | 11/1989 | Duncan | 219/388 |
| 5,362,945 | 11/1994 | Baader | 219/619 |
| 5,624,593 | 4/1997 | Martens | 219/619 |
| 5,634,282 | 6/1997 | Pikus | 34/266 |

FOREIGN PATENT DOCUMENTS

| | | |
|---|---|---|
| 0 068 119 | 5/1982 | European Pat. Off. . |
| 0 622 972 | 10/1989 | European Pat. Off. . |
| 43 13 837 | 9/1994 | Germany . |
| 1 089 529 | 11/1967 | United Kingdom . |
| 2 216 457 | 10/1989 | United Kingdom . |

*Primary Examiner*—Teresa Walberg
*Assistant Examiner*—Daniel Leon Robinson
*Attorney, Agent, or Firm*—Herbert Dubno

[57] ABSTRACT

A low-loss, high-energy efficiency and low-cost heatable godet has a plurality of short wavelength infrared radiation heaters closely juxtaposed with the inner wall of the hollow drum of a godet onto which a synthetic yarn can be fed. The heaters can be angularly equispaced within the interior of the drum, closely juxtaposed therewith and of different lengths to heat different axial zones of the drum differently. The heaters can be coated with a reflective material on their sides turned away from the drum to avoid scattering losses and to direct energy to the drum.

6 Claims, 2 Drawing Sheets

HEATED GODET FOR THE HEATING OF SYNTHETIC YARN

FIELD OF THE INVENTION

Our present invention relates to a heated godet and, more particularly, to a device for the heating of synthetic yarn, e.g. in the stretching or modification of the yarn structure, as part of a plant for the production or spinning of synthetic yarn.

BACKGROUND OF THE INVENTION

From U.S. Pat. No. 3,487,187 and 3,435,171, for example, and others, it is known to wind a synthetic yarn in one or more turns about the rotary drum of a heated godet to heat the yarn for stretching or some other modification of the yarn structure. Such devices are widely used in plants for the production of synthetic yarn between the spinerettes in which the synthetic filaments are produced, and the machine parts at which the synthetic yarn is wound in bobbins or in yarn packages. Control of the temperature is described, for example, in the commonly owned copending application Ser. No. 08/630,823 of 10 Apr. 1996 (now U.S. Pat. No. 5,712,467 of 27 Jan. 1998).

Godets for the aforedescribed purpose can be heated by means of liquid or gaseous media and, for example, superheated steam or a medium which condenses in the heating process. Heating can also be effected by electrical resistance heaters. Perhaps the best results to date are obtained by heating the godets utilizing induction heating techniques with, for example, a primary winding of the induction heater located within the interior of the godet and fed with alternating current to induce, in a magnetostrictive material like steel or copper forming the shell of the godet, eddy currents which, in turn, generate heat.

In DE 43 13 837, moreover, different zones of the godet are differently heated or supplied in a controlled manner with the different amounts of energy to satisfy the desire for heating the yarn differently in these zones.

The cost of heating godets of this type are considerable, especially with godets of large diameters up to, say 300 mm, and considerable lengths of say 500 mm or more. These costs include the high capital cost as well as the high energy cost, the latter being a consequence in part of the high energy losses in such systems.

OBJECTS OF THE INVENTION

It is, therefore, the principal object of our present invention to provide a heated godet which can be of large size but which can be heated more simply, with reduced energy losses.

It is another object of the invention to provide an improved heated godet in which the capital cost can be reduced even for the heating of a godet of large size.

It is also an object of the invention to provide a heated godet for heating synthetic yarn which can pass around the godet in one or more turns, which enables a zone-wise distinction between the energy delivered to successive zones axially along the godet.

Yet a further object of the invention is to provide an improved godet for the purposes described which will be free from drawbacks of prior-art godets.

SUMMARY OF THE INVENTION

These objects and others will become more readily apparent with a heated godet in which at least one short wavelength infrared heater is disposed within the interior of the godet. According to the invention, therefore, the godet for heating a synthetic yarn passing over the periphery of the godet can comprise:

a hollow thermally conductive drum rotatable about an axis and having an external surface adapted to receive at least one turn of a synthetic yarn to be heated;

means for rotatably supporting the drum; and at least one short-wave infrared heater within an interior of the drum for heating the drum.

While British patent document 2 216 457B already has described the heating of a pin along the surface of which a synthetic yarn can be stretched by an electric resistance heater in the interior of this pin and which heats the shell of the pin by radiation, the radiation here used is very long-wave thermal radiation which has been found to be extremely inefficient. The heating device has a high thermal inertia since the resistance heater must initially heat the heating body before this can radiate heat to the shell of the stretching pin.

By contrast, the infrared radiant heater of the invention which can be juxtaposed closely with the inner surface of the shell of the godet, emits a radiation whose wavelength has a maximum between 1 $\mu$m and 2.5 $\mu$m depending upon the application. This band of wavelengths results in transformation of the radiation to heating of the metal shell with a high degree of efficiency. Such infrared radiant heaters are commercially available from the firm Heraeus. They have been used previously, also in the textile field, for the direct contactless heating of organic material in the form of monodimensional products such as threads or two-dimensional products such as foils, fabrics or fleeces. In these systems, the product is displaced in close juxtaposition to the infrared radiant heater directly, i.e. without the intervention of any other heating body. Another use for such heaters previously has been the direct contactless heating of three-dimensional objects, for example, for baking lacquers onto coated objects which can be located at various distances from the infrared heater.

It has now been found that an indirect transfer of the thermal energy from the radiation-emitting infrared radiant heater through a heat carrier which is inductively heatable, to the yarn can be advantageous since this heat-transferring drum moves relative to the heater or heaters at a constant distance therefrom and can receive heat by radiation and convection and can transfer that heat through the drum by conduction. Energy losses by scattering are minimal, especially when the infrared heater is provided on its side opposite the inner surface of the drum, with a reflective coating.

According to the invention, the means for rotatably supporting the drum includes a stationary support, the infrared heater being elongated, being fixed at one end to the support and extending longitudinally in the drum parallel to the axis and in close juxtaposition with an inner surface of the drum.

The infrared heater can include a short wavelength infrared heating element received in a closed tube composed of quartz glass. A plurality of infrared heaters are preferably provided in the drum in angularly equispaced relationship and one side of each of the heaters can be formed with a reflecting layer collecting infrared radiation and concentrating the infrared radiation on an inner surface of the drum.

According to the invention the drum has a shell, and the godet further comprises at least one temperature sensor in the shell and connects to the heater for controlling heating power of the heater.

The short wavelength heaters can be provided of different lengths so that they extend to different axial extents within the drum and thus are arranged to heat the drum at axially different zones to different temperatures.

The godet can have at least one temperature sensor in the shell of the drum at each of the zones and connected to the heaters for controlling the powers of the heaters independently.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
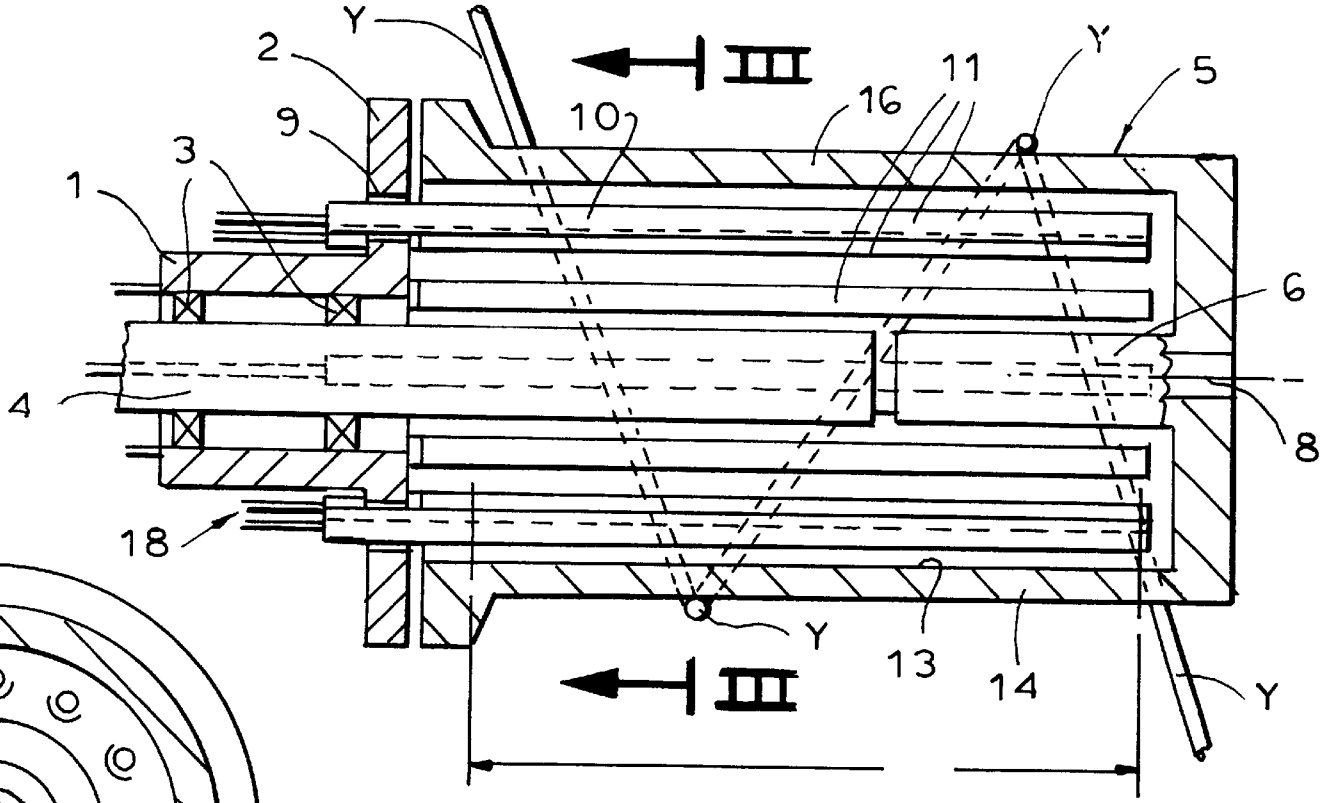
FIG. 1 is an axial section through a first embodiment of the godet according to the invention.

FIG. 1 shows a godet having a bearing bushing 1 mounted in a textile machine between a source of a synthetic yarn Y and a station in which the yarn is wound up, for heating the yarn Y which passes in at least one turn around the godet and can be brought to a stretching temperature by contact with the heated outer periphery of the godet. Within the bearing bushing, which has a fixed support plate 2, a shaft 4 is journaled by means of two roller bearings 3 and carries the godet drum 5. At its left-hand end, the shaft 4 is driven in any conventional way, e.g. via a motor.

Figure 2:
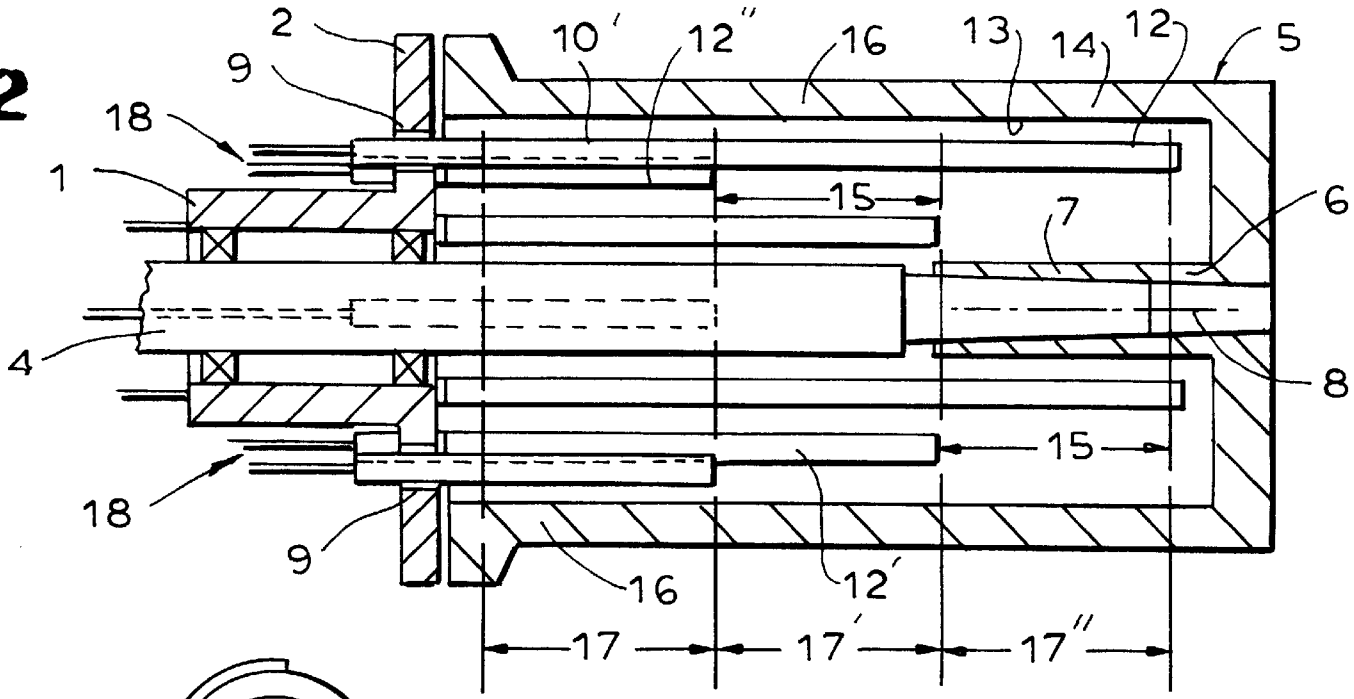
FIG. 2 is an axial section through a godet according to a second embodiment.

Within the drum the godet 5 has a hub 6 which, as seen in FIG. 2 can have a conical seat 7 engaging the complementarily-shaped free end of the shaft 4 and can be held on that shaft by a screw represented by the screw axis 8.

In bores 9 of the support plate 2 (FIGS. 1 and 2), the tubes 10 of infrared (IR) radiant heaters 11 or 12, 12', 12" (FIG. 2) are affixed, the heaters 11 or 12, 12', 12" being angularly equispaced within the heaters and extending into the interior of the drum close to the inner surface 13 of the shell 14 of the godet.

Figure 3:
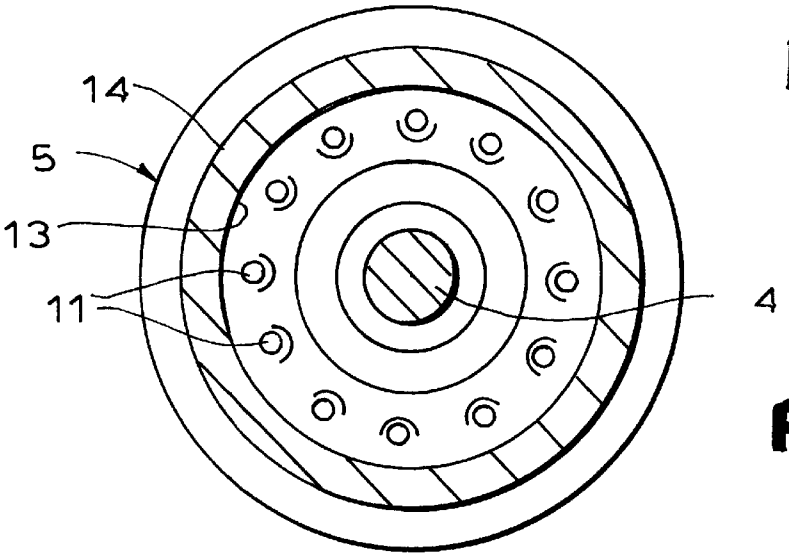
FIG. 3 is a section taken along line III—III of FIG. 1.

In the embodiment of FIG. 1, the infrared radiant heaters 11 are so long that their radiation zones 15 extend over the entire inner length of the godet and uniformly warm the drum over its entire axial length. In this embodiment (see FIGS. 1 and 3), twelve such infrared radiant heaters 11 are disposed equidistantly from the axis of the drum 5 and from one another about an imaginary cylinder surface which is coaxial with the drum 5. Depending upon the heating requirements of the drum and the heating power of the individual infrared radiant heater, a greater or lesser number of such heaters can be used. In the shell 14 of the drum, at least one temperature sensor 16 is provided which produces a measurement signal for the temperature of the shell. This signal can be communicated to a control unit via a slip ring system connected to a temperature controller which feeds electrical power to the electrically-operated heaters. The temperature signal can also be picked up by a contactless system.

It has been found that the heating requirements of the godet 5 is usually not constant over its entire length, whether because the radiant heat losses in which regions are greater than in a central region or because the region which is first contacted by the yarn has a greater heat requirement than the region in which the yarn is paid off the drum. It has been found to be advantageous in that case to heat the drum in zones and, for that purpose, some of the infrared radiant heaters 12, 12', 12" can be shorter than others so that different numbers of the heaters are effective in the different zones and only the longest heaters heat the drum over the entire length thereof. Based upon the various lengths of the heaters, the drum is heated in respective zones. Since some of the heaters are effective only over a limited portion of their lengths, heaters with greater power density or a larger number of heaters may be used in this embodiment. Because the zones are heated differently, each of these zones can have a respective temperature sensor 16, 16', etc.

In FIG. 2 three zones 17, 17', 17" are provided although it is possible to operate with only two zones or more than three zones. The multiple zones are advantageous both when it is desired to operate with a highly precise uniformity of the temperature over the length of the drum as well as when in its desire maintain different temperatures at these several zones. The electrical conductors supplying the heaters have been represented at 18.

The infrared radiant heaters 11, 12, 12', 12", heat the shell 14 of the godet 5 from within to the desired temperature, say 250° C. The temperatures outputted by the sensors 16, 16', etc. are compared with setpoint values and deviations can be corrected by varying the time for which the infrared radiant heaters are energized for the voltage applied across the heaters.

Figure 4:
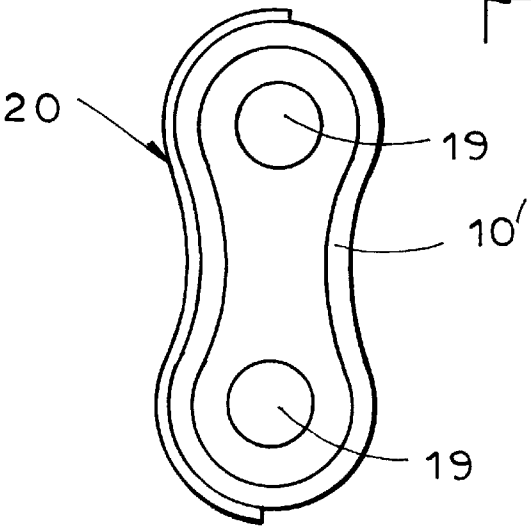
FIG. 4 is a section through a double infrared radiant heater according to the invention.

The infrared radiant heaters 11, 12, 12', 12" can be simple quartz glass tubes in which a resistance heating wire is coiled. To achieve a high heat power per unit length or per unit of radiating surface, the double infrared radiation heater shown in FIG. 4 can be used. In this case, the radiant heater comprises a FIG. 8 quartz glass tube 10' in which two wire windings or coils 19 are arranged.

The godet may be typically equipped with six infrared heaters each having a power of 75 watts to heat the rear zone 17", six heating rods with powers of 1000 watts to heat the intermediate zone 17' and four heating rods each at 600 watts to heat the front zone 17.

The infrared radiant heaters 11, 12, 12', 12" are all coated on one side with a reflecting layer of a vapor-deposited metal like gold to direct the radiation, after concentrating it, upon the inner surface of the drum 5. A corresponding reflecting layer has been shown at 20 in FIG. 4. Useless scattering of radiation toward the shaft 4 can thus be avoided and the energy consumption reduced.

We claim:

1. A godet for heating a synthetic yarn comprising:

a hollow thermally conductive drum rotatable about an axis and having an external surface adapted to receive at least one turn of a synthetic yarn to be heated;

means for rotatably supporting said drum; and a plurality of mutually parallel angularly equispaced short-wave infrared heaters with a wavelength maximum between about 1 and 2.5 $\mu$m within an interior of said drum and juxtaposed with an inner surface of said drum for heating said drum each of said heaters including a short-wave infrared heating element received in a closed tube composed of quartz glass.

2. The godet defined in claim 1 wherein said means for rotatable supporting said drum includes a stationary support, said infrared heaters being fixed at one end to said support and extending longitudinally in said drum parallel to said axis and in close juxtaposition with an inner surface of said drum.

3. The godet defined in claim 2 wherein a said infrared heaters are spaced from one another, one side of each of said heaters being formed with a reflecting layer collecting infrared radiation and concentrating said infrared radiation on an inner surface of said drum.

4. The godet defined in claim 1 wherein said drum has a shell, said godet further comprising at least one temperature sensor in said shell and connected to said heaters for controlling heating power of said heaters.

5. The godet defined in claim 1 which comprises a plurality of short-wave heaters constructed and arranged to heat said drum at axially distinct zones to different temperatures.

6. The godet defined in claim 5 wherein said drum has a shell, said godet further comprising at least one temperature sensor in said shell at each of said zones and connected to said heaters for controlling heating power of said heaters for said zones independently.

* * * * *